US005566848A

United States Patent [19]

Rude et al.

[11] Patent Number: 5,566,848

[45] Date of Patent: Oct. 22, 1996

[54] SLOPED BOTTOM TANK

[75] Inventors: Arthur D. Rude, Ash Grove; Vinton F. Horine, Springfield, both of Mo.

[73] Assignee: Custom Metalcraft, Inc., Springfield, Mo.

[21] Appl. No.: 446,059

[22] Filed: May 19, 1995

Related U.S. Application Data

[62] Division of Ser. No. 214,567, Mar. 18, 1994, Pat. No. 5,505,070.

[51] Int. Cl.[6] ..... B65D 6/00

[52] U.S. Cl. ..... 220/4.12; 220/1.5; 220/62; 220/601; 220/628; 220/636; 220/DIG. 6

[58] Field of Search ..... 220/571, 573, 220/601, 62, 62.1, 628, 636, 638, 4.12, 1.5, DIG. 6

[56] References Cited

U.S. PATENT DOCUMENTS

| | | | |
|---|---|---|---|
| 672,275 | 4/1901 | Leighton | 220/62 X |
| 3,063,766 | 11/1962 | Goettl | 220/571 X |
| 4,054,184 | 10/1977 | Marcinko | 220/573 X |
| 4,785,958 | 11/1988 | Snyder | 220/62 X |
| 5,339,676 | 8/1994 | Johnson | 220/571 X |

*Primary Examiner*—Stephen K. Cronin
*Attorney, Agent, or Firm*—Nies, Kurz, Bergert & Tamburro

[57] ABSTRACT

An improved tank bottom configuration formed from a flat metal plate of square or rectangular shape is disclosed. The plate is sheared to provide two adjacent sides which are tapered along their lengths and a notch is cut in each corner portion. By the use of stop and die members, the plate member is deformed to provide a bottom wall portion which slopes downwardly toward one corner and upwardly extending side wall portions which extend around the periphery of the bottom wall portion. A drain opening and a crease are formed in the bottom wall portion, with the crease being aligned with and spaced from the drain opening.

8 Claims, 8 Drawing Sheets

90
12
30
31
80
33
82
94
94
92

12
90
30
31
80
33
82
94
94
92

90
12
80
30
33
82
31
94
94
92

12
90
30
80
33
82
31
94
94
92

FIG. 12
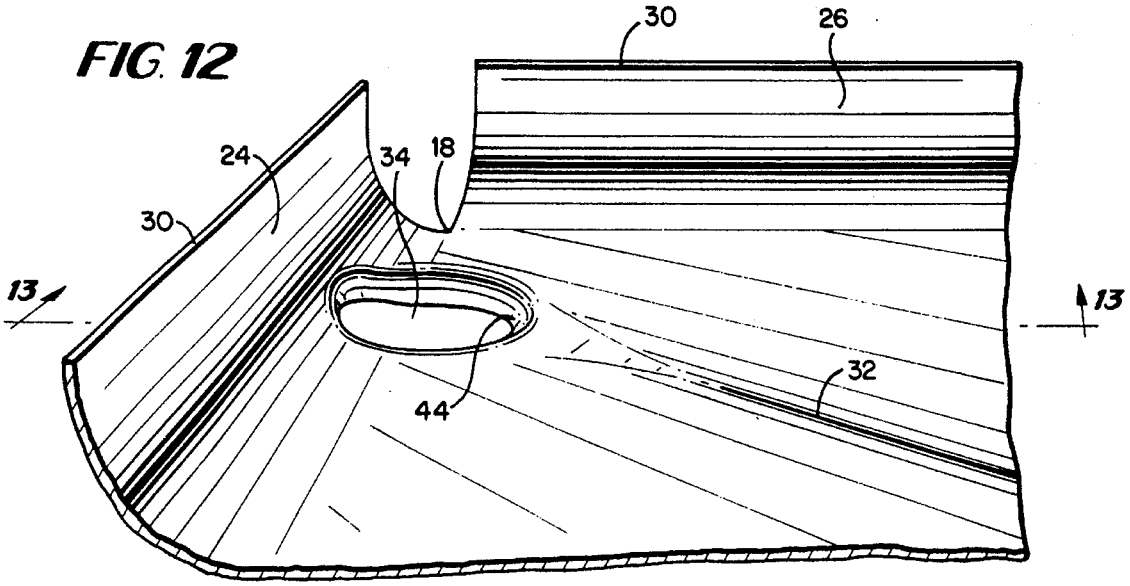
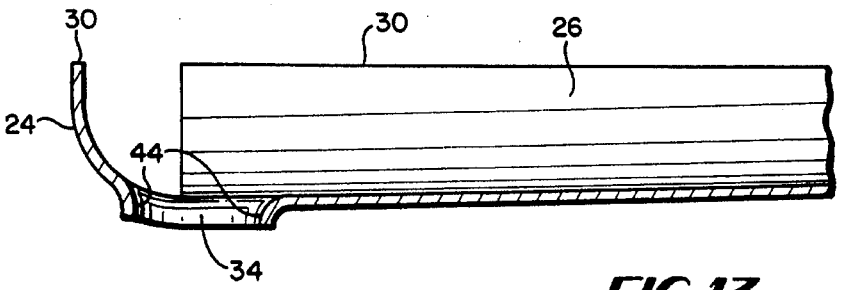
FIG. 13
FIG. 14
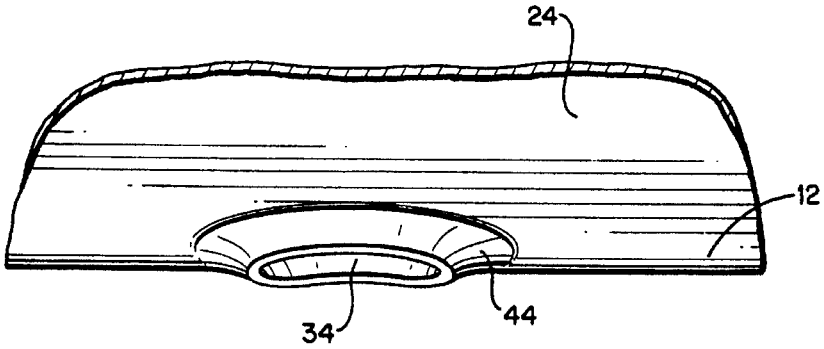

FIG. 15
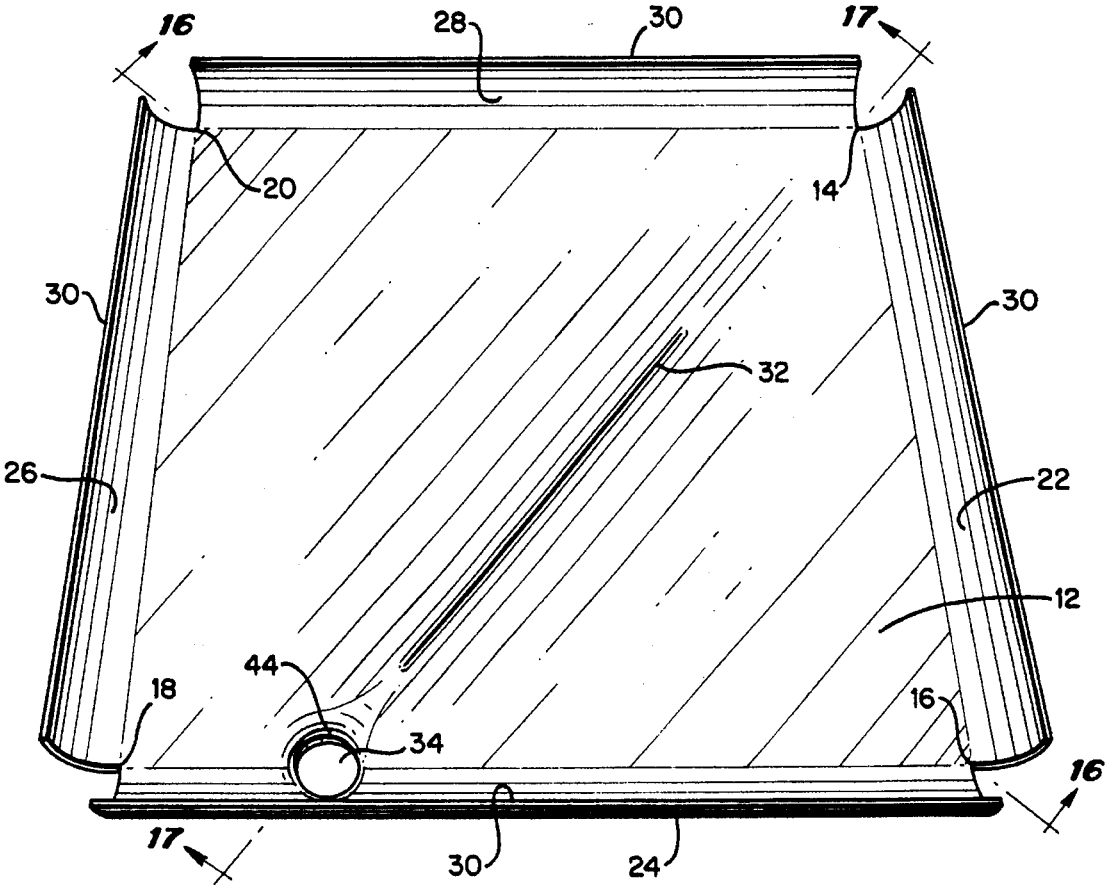
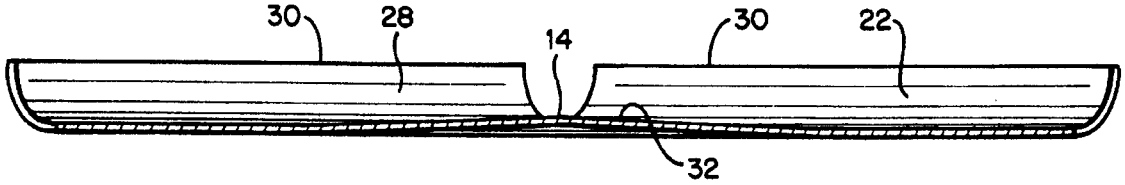
FIG. 16
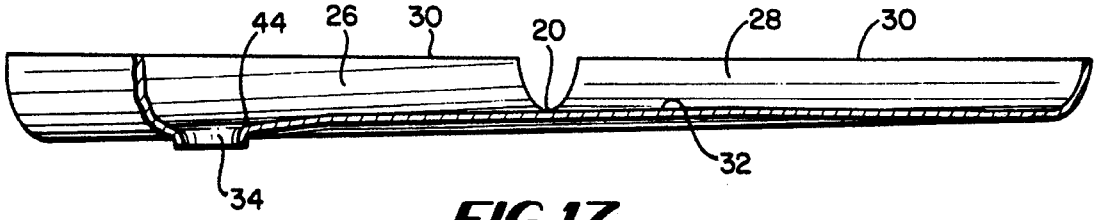
FIG. 17

SLOPED BOTTOM TANK

This is a division of application Ser. No. 214,567 filed Mar. 18, 1994 now U.S. Pat. No. 5,505,070.

BACKGROUND AND SUMMARY OF THE INVENTION

The present invention relates to a portable tank having an improved bottom configuration. More particularly, the present invention relates to a shearing pattern with a crease break for the bottom of a portable tank having improved features with regard to manufacture and use of the tank.

Previous portable tank configurations are described, for example, in the following U.S. Pat. Nos.: 948,994 to Howland; 1,007,633 to Beaton; 1,647,900 to Carpenter; 1,802,426 to Hoyt; 3,379,329 to Bryans et al; 4,557,406 Olinger et al; 4,746,034 to Ata et al.; 4,782,973 to Wiese; 4,785,958 to Snyder; and 4,840,284 to Snyder. Problems encountered with previous tank configurations have included difficulty in obtaining complete drainage of the tank. Often, the solutions created have required complex bottom structures.

By the present invention, there is provided an improved tank configuration with regard to the bottom portion thereof, wherein a flat sheet metal blank has notched corners which are sealed, by welding or the like, after the side edges are broken by the use of die members to form the tank bottom sides. Two of the side edges are sheared at angles and, when broken and sealed at their common corner, cooperate with an upward crease break in the bottom portion to provide a tank bottom which slopes with complete drainage toward a drain hole. The drain hole is formed so as to have a partly tapered edge to optimize drainage. The tank construction of the present invention eliminates the need for a divergent gap to create the desired tank bottom drainage, as described in U.S. Pat. No. 4,785,958 to Snyder. By the present invention, commencing with a flat piece of metal such as stainless steel or aluminum, by proper shearing and breaking, a metal bottom head of any size may be obtained that will drain the liquid product from the head.

Accordingly, it is an object of the present invention to provide an improved tank bottom which combines the steps of shearing and breaking the side edges of the tank bottom with breaking the slope of the tank bottom so as to provide complete drainage to a corner portion of the tank bottom.

It is another object of the present invention to provide an improved tank bottom which eliminates the need for a divergent gap to create the desired tank bottom drainage.

It is a further object of the present invention to provide an improved tank bottom which may be utilized on standard or special size bases when desired and which provides excellent drainage and sanitary conditions for situations requiring complete drainage.

It is another object of the present invention to allow the fabrication of various depth pitched bottom heads.

It is still another object of the present invention to provide an improved tank bottom which requires minimum welding around the outlet area as is desired in the industry.

It is still a further object of the present invention to provide an improved tank bottom which does not require stamping or swedge pressing the head to a slope.

BRIEF DESCRIPTION OF THE DRAWINGS

FIG. 12 is a side perspective view showing the drain hole of the present invention after the tank bottom has been swage-pressed and creased.

FIG. 13 is a side view of the tank bottom corner having the drain hole taken along line 13—13 of FIG. 12.

FIG. 14 is a front perspective view of the tank bottom after the sides have been broken and the tank bottom has been swage-pressed and creased.

FIG. 15 is a bottom perspective view of the interior of the tank bottom after the sides have been broken and the tank bottom has been swage-pressed and creased.

FIG. 16 is a side elevation view of the tank bottom of FIG. 15 taken along line 16—16 of FIG. 15.

FIG. 17 is a side elevation view of the tank bottom of FIG. 15 taken along line 17—17 of FIG. 15.

DESCRIPTION OF THE PREFERRED EMBODIMENTS

Figure 1:
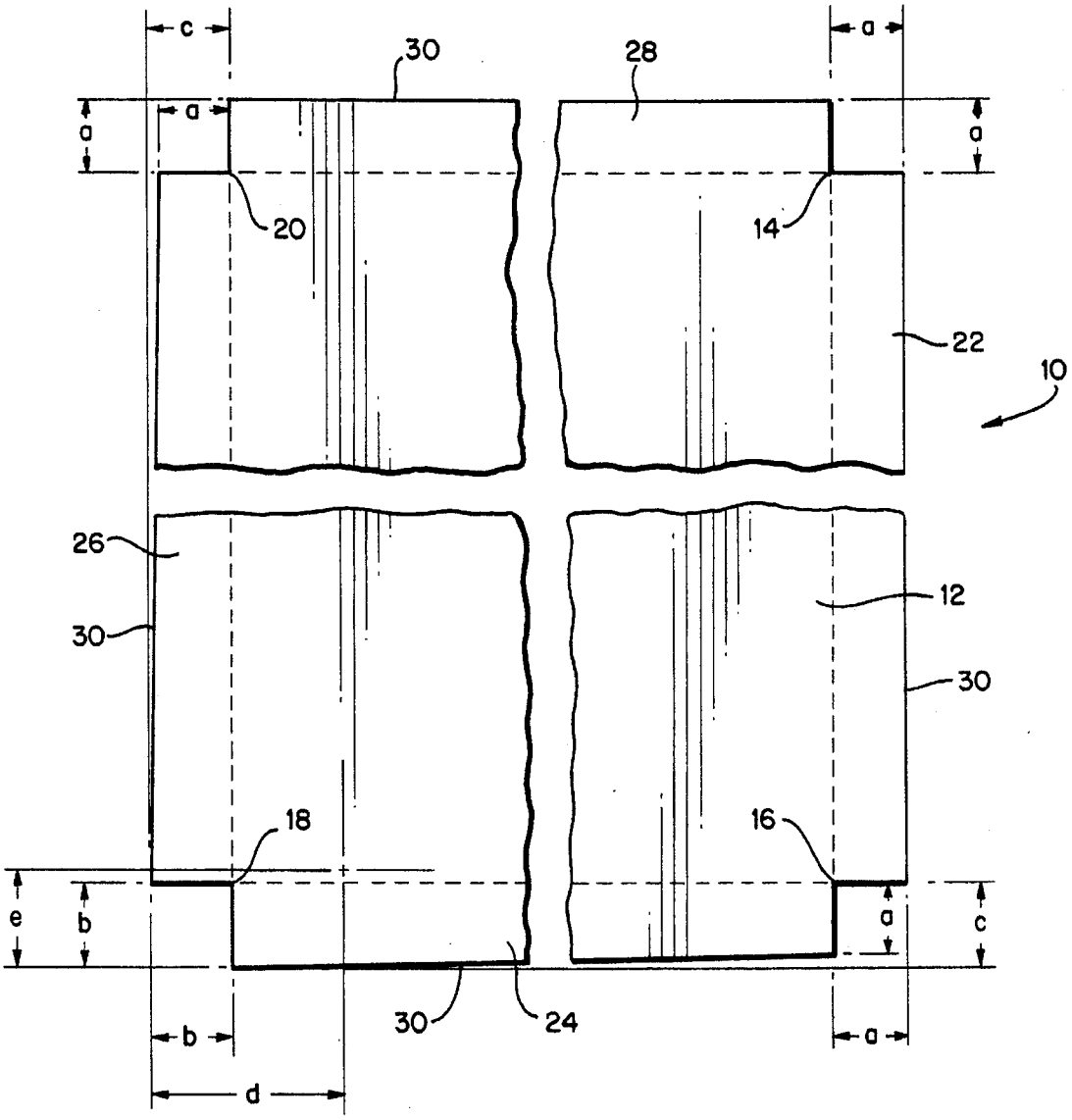
FIG. 1 is a top plan view of the sloped bottom tank of the present invention showing the sheared edges and corners in the unformed condition.

In the embodiment of the invention as shown in FIGS. 1 through 17, there is provided a tank bottom 10 having a bottom portion 12 made of a flat sheet metal blank, with four notched corners 14, 16, 18, and 20 formed by shearing the metal blank 12, and four side members 22, 24, 26, 28 each having a side edge 30.

Each of the three corners 14, 16 and 20 is sheared such that a square-shaped notch of the same dimensions is provided and the fourth corner 18 is sheared such that a larger square-shaped notch is provided. This is accomplished while also shearing side members 24 and 26 at an angle as shown in FIG. 1 so as to not be parallel with opposing members 28 and 22, respectively. The shearing is accomplished prior to forming the flat plate 12 by means of die members. Thus the dimension "a" for corners 14, 16 and 20 will be the same so as to provide three square-shaped notches of equal size while the dimension "b" of corner 18 will be larger than "a" by the amount by which dimension "c" exceeds dimension "a" in corners 16 and 20. By the use of such related dimensions for the notches and the tapered sides, upon forming the tank bottom a downward slope toward corner 18 will be provided.

In one embodiment of the invention, the identical corners 14, 16 and 20 are sheared in a 42 inch by 42 inch blank to provide notches which are 3⅝ inch square and with the notch in the fourth corner 18 being 4⅛ inch square. Dimension "c" is also 4⅛ inch so that a taper of ½ inch is obtained. By the use of these dimensions, when the side members 22, 24, 26, 28 are broken upwards by the die members such that side edges 30 remain level, or in the same plane, corner 18 will be lower than corners 14, 16, and 20 such that a ½ inch slope is provided toward corner 18.

The bending or "breaking" of the side edges 30 is accomplished by using custom built die combinations 90, 92 and back stops 96, 97 as shown in FIGS. 3 through 10. The top die 90 includes a solid round rod attached to a conventional actuating mechanism for the die 90. The bottom die 92 is in the form of a U-shaped cast die which is wider than the top die 90, as shown in FIGS. 4 through 7, and has a gripping surface 94 made of amber polyurethane rubber or the like extending along the sides of the bottom die 92 to give grip to metal so it does not slip and to prevent scratching of the side edges 30 of the metal plate 12. Back stops 96, 97 include a two stage overlay of two metal plates 80, 82, and are arranged such that the top plate 82 is spaced back from the leading edge 31 of the bottom plate 80 so as to accommodate the tapered side edges 30 being formed.

Figure 4:
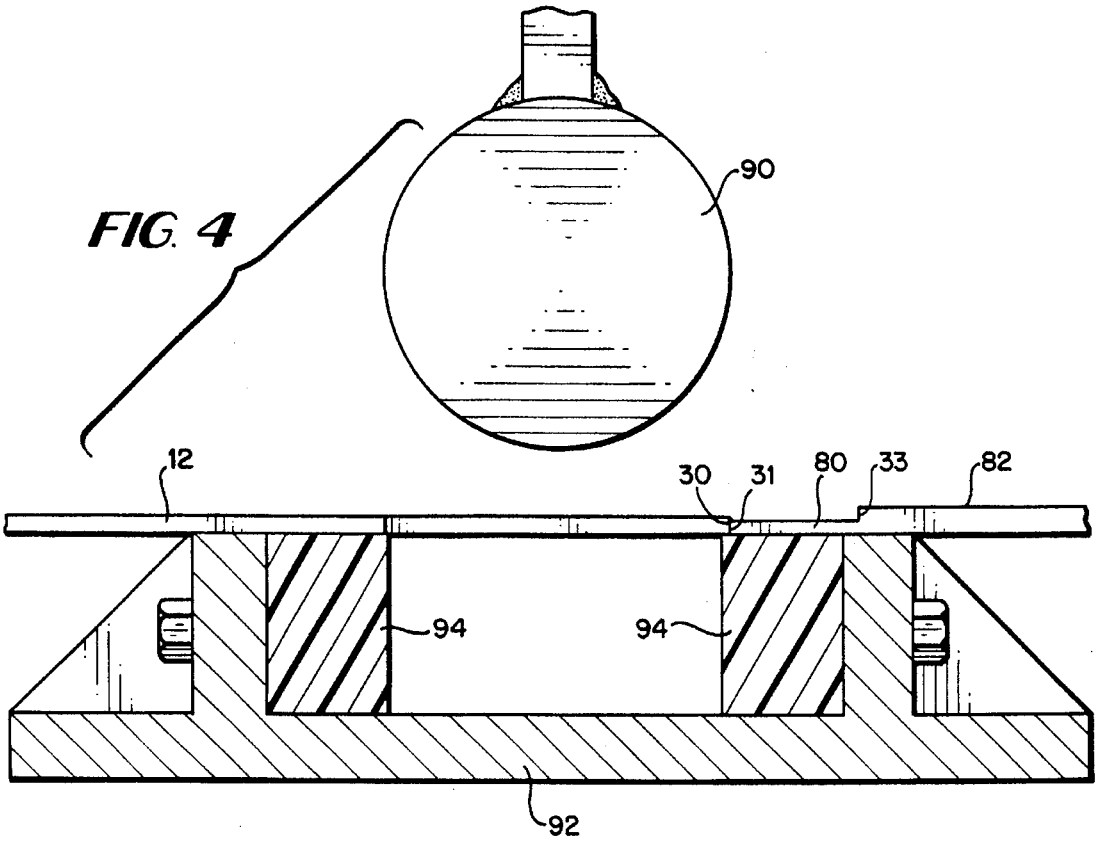
FIG. 4 is a front elevation of the head forming dies and back stops before the breaking of an even or untapered side of the tank bottom of the present invention.
Figure 5:
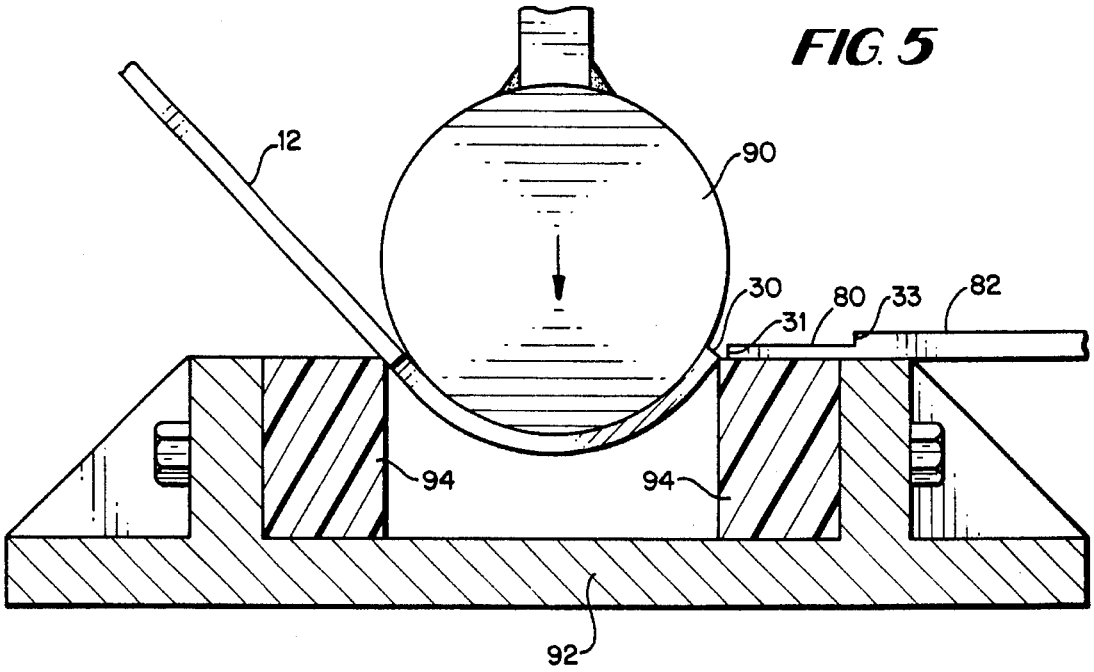
FIG. 5 is a front elevation of the head forming dies and back stops in operation as an even or untapered side of the tank bottom is being broken.
Figure 10:
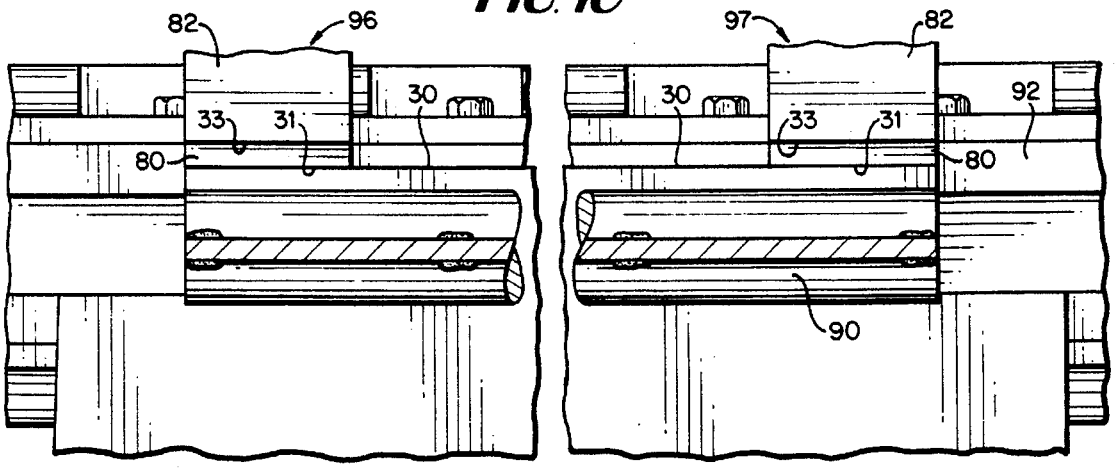
FIG. 10 shows a fragmented top plan view of the positioning of an even or untapered edge between the head forming dies and abutting the back stops of the present invention.

Side members 22 and 28 which are not tapered are broken up as shown in FIGS. 4, 5, and 10. The side edge 30 of the side member 22 or 28 being formed is placed between the die members 90, 92 so as to abut the leading edge 31 of lower metal member 80. The top die 90 is then lowered by the die actuating mechanism to break the side member 22 or 28.

Figure 6:
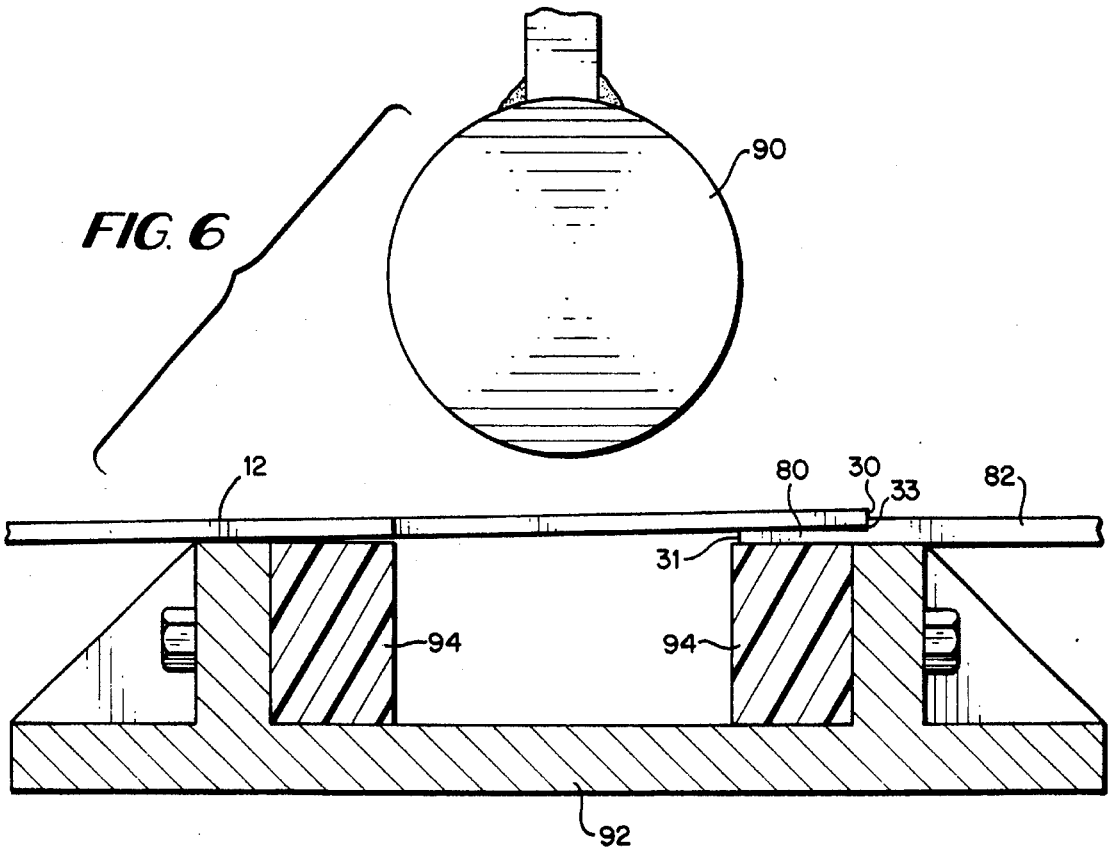
FIG. 6 is a front elevation of the head forming dies and back stops before the breaking of an uneven or tapered side of the tank bottom of the present invention.
Figure 7:
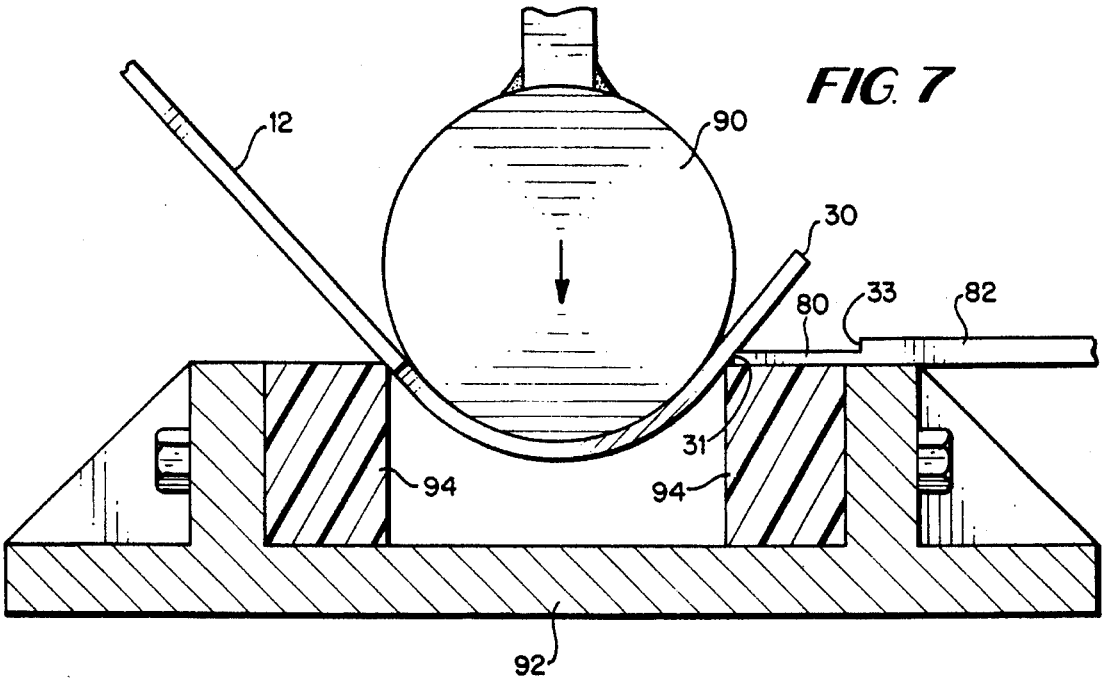
FIG. 7 is a front elevation of the head forming dies and back stops in operation, showing an uneven or tapered side of the tank bottom being broken.
Figure 8:
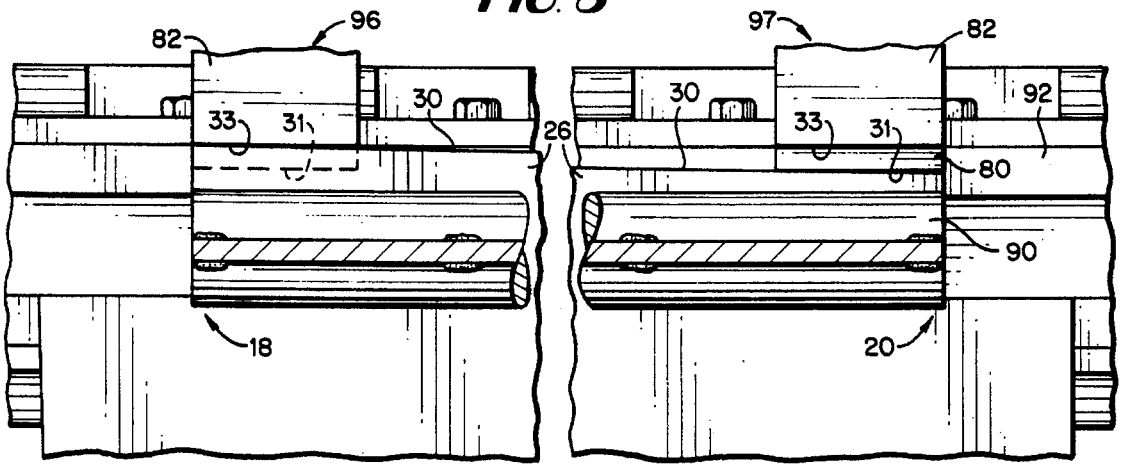
FIG. 8 shows a fragmented top plan view of the positioning of a first uneven or tapered edge between the head forming dies and abutting the back stops of the present invention.
Figure 9:
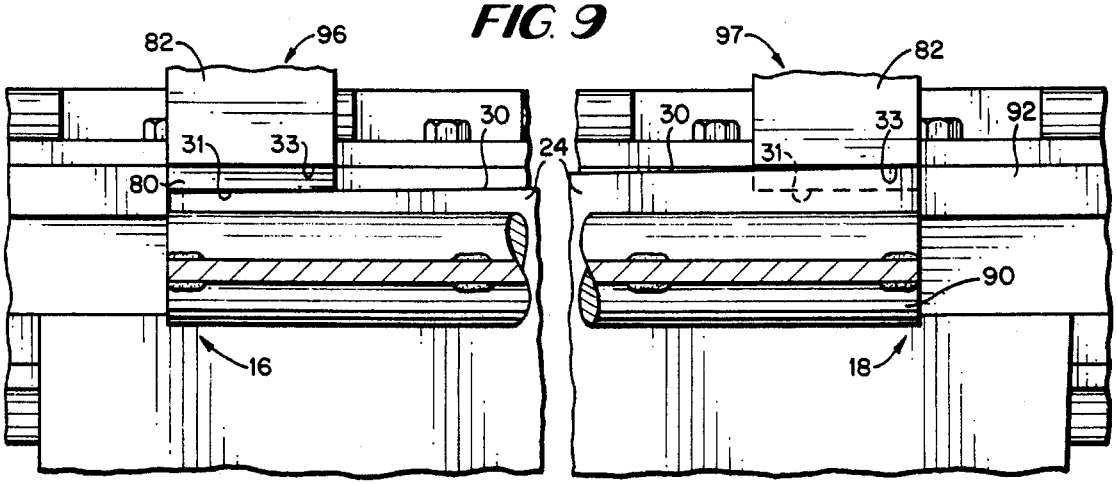
FIG. 9 shows a fragmented top plan view of the positioning of a second uneven or tapered edge between the head forming dies and abutting the back stops of the present invention.

As shown in FIG. 9, tapered side member 24 is broken by having its edge 30 near corner 16 held against the leading edge 31 of lower metal member 80, while having its edge 30 near corner 18 held against the edge 33 of upper metal member 82, as shown in FIGS. 6 and 7. As shown in FIG. 8, tapered side member 26 is broken by having its edge 30 near corner 20 held against the leading edge of lower metal member 80 while having its edge 30 near corner 18 held against the edge 33 of upper metal member 82, as shown in FIGS. 6 and 7.

In breaking the various sides of the tank bottom, the top die 90 should be of a length equal to that of the longest side without extending past the ends of the notch area. Thus by starting at the short end of the head and breaking the sides of the head working back to the longest side, the top die 90 will fit into this break area with the other three sides having been broken.

Figure 2:
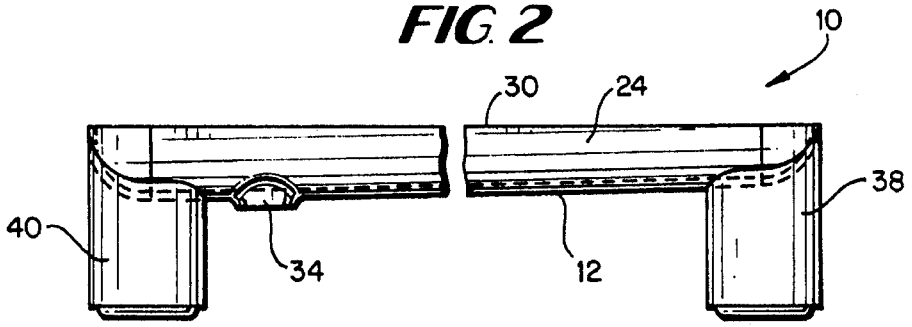
FIG. 2 is a front elevation of the sloped bottom tank of the present invention in the formed condition.
Figure 3:
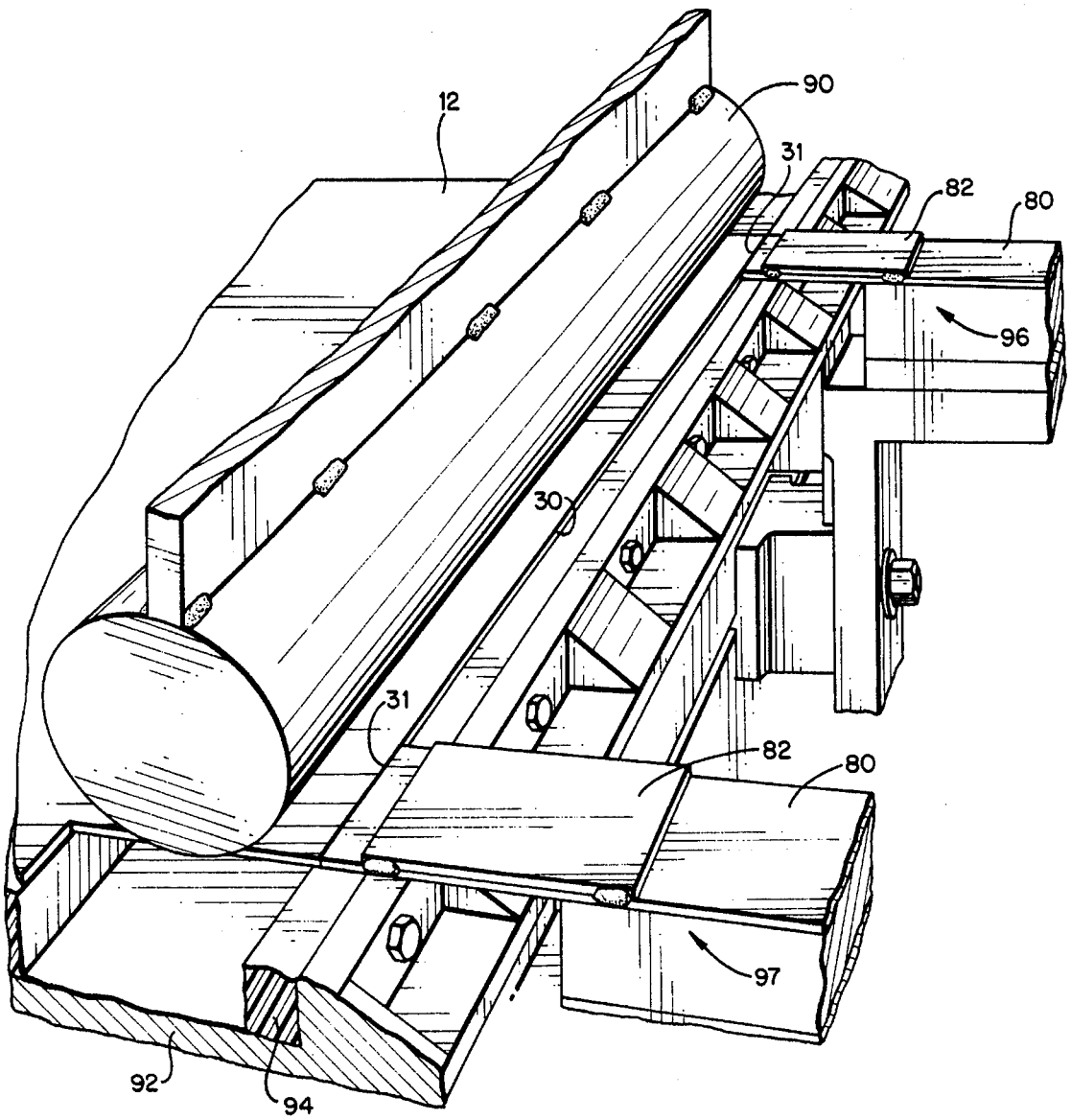
FIG. 3 is a perspective view of the head forming dies and back stops used in breaking the sides of the tank bottom of the present invention.

This positioning of side members 22, 24, 26, 28 combined with the shearing pattern earlier described results in corner 18 being lower than corners 14, 16, 20, as shown in FIG. 2. Also, this allows the side members 24, 26, which were sheared at an angle, to break straight resulting in a level surface on all four sides on which a tank shell can be securely tacked.

Figure 11:
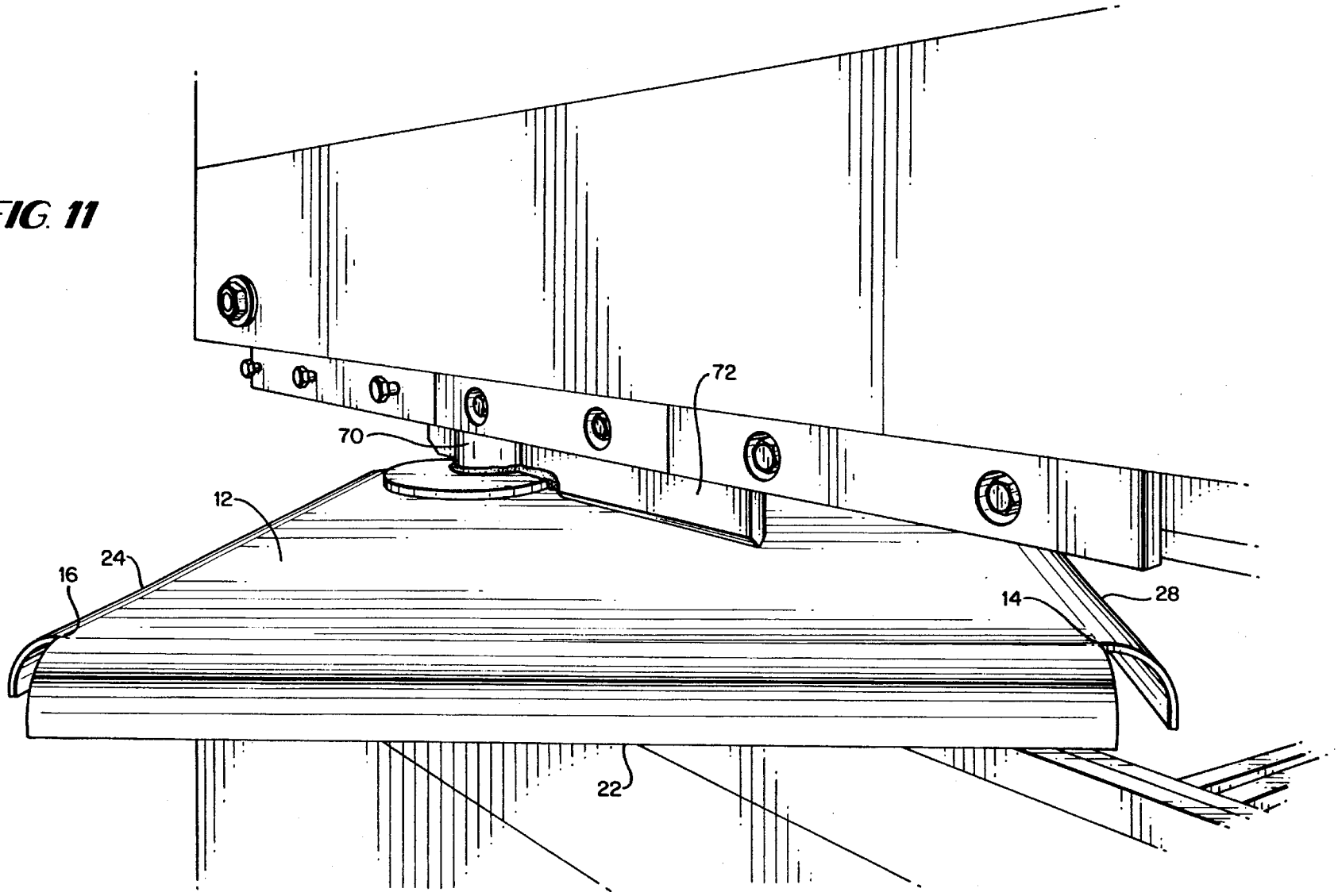
FIG. 11 shows a perspective view of the inverted tank bottom of the present invention as it is swage-pressed and creased.

After the sides have been broken as described above, a drain opening 34 is cut in the metal plate 12 in the area adjacent corner 18. The opening 34 may be cut by the use of a plasma arc cutting torch, for example, which is set at 45 degrees to the metal surface. The opening 34 may be cut on the edge of the slope of side member 24, as shown in FIGS. 12 and 15, so as to form an egg shaped hole. When the hole is swaged, there is thus provided a level swaged opening 34 with tapered surface 44. A swage press 70 is employed, as shown in FIG. 11, to swage the opening 34 and with a blade 72 provided for use in imparting a single crease 32 which will extend upwardly when the bottom 12 is inverted. A suitable pipe nipple with elbow fitting may be welded to the outlet end of the opening 34.

The upward crease 32 as formed by the blade press 72 is of uniform height throughout its length, as shown in FIG. 17. The crease 32 is formed with an angle or slope which extends outwardly from the crease 32 in the direction of corners 16 and 20, as shown in FIG. 16. In one embodiment, in which a 42 inch by 42 inch blank is initially employed, the upward crease 32 is formed or broken with an angle or slope of about 7 to 10 degrees relative to the horizontal plane of the bottom portion 12. For larger size tanks, the slope will be greater. In general, the length of the crease 32 will be determined by the size of the bottom head and crease height is determined by the hydrostatic pressure in a full tank.

As shown in FIGS. 12 and 15, the crease 32 is formed so that it does not extend all the way to the drain opening 34. Thus there is a downward slope from the near end of the crease 32 to the drain opening 34 as shown in FIG. 17. In positioning the drain opening 34 and the crease 32, dimensions "d" and "e" should be selected so that the drain opening 34 will be located in the vicinity of the corner 18, bearing in mind the downward slope of the bottom 12 when the sides are broken and also the necessity for providing clearance between the fittings attached to the underside of the opening 34 and the tank leg 40. By locating the drain opening 34 on the slope of side member 24, the opening 34 will also be out of the way during fork lift operations. In forming the crease 32, the swage press 70 should be aligned so that the crease 32 will extend on a line between the drain opening 34 and the opposite corner 14. In one embodiment of the invention, the crease 32 had a length of 16 inches and there was an interval of 4 inches between the drain opening 34 and the crease 32.

When the drain opening 34 and crease 32 have been formed, a curved notch-shaped piece may then be inserted and welded at each opening in the corners 14, 16, 18 and 20 so as to provide smooth rounded corner surfaces.

Corner leg members 38, 40 are then sealed in place as shown in FIG. 2 to connect side members 22, 24, 26, 28 together, with corner leg member 40 nearest the drain opening 34 being shorter than the other three corner leg members 38 so as to accommodate the slope of corner 18. The legs 38, 40 may be contoured to the bottom to provide good support.

By the present invention, there is provided a tank bottom having a downward slope to one corner and with a generally flat overall bottom contour which allows safe handling of the tank. When liquid within a storage tank having bottom 10 is desired to be drained, the liquid is directed by the upward crease 32 in the bottom portion 12 of the tank bottom 10 away from the middle of the bottom portion 12 and down towards the drain opening 34 near corner 18 due to the sloped bottom configuration.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein,

What is claimed and desired to be secured by Letters Patent is:

1. A tank for liquids, said tank having generally upwardly extending sides and a sloped bottom for drainage of liquid from the tank, wherein said sloped bottom includes a one-piece construction formed from a square or rectangular shaped plate member which is generally flat and has a plurality of corner portions and which is sheared to provide two adjacent sides, each of which is tapered inwardly along the length thereof and which together define one of said corner portions, and with the other two sides of said plate member being perpendicular to each other, each of said tapered sides being tapered inwardly from its respective end which defines said one of said corner portions, and with a notch having been cut in each corner portion, said plate member having been deformed to provide a bottom wall portion which slopes downwardly toward said one of said corner portions and upwardly extending side wall portions which extend around the periphery of said bottom wall portion, and with a drain opening and a crease formed in said bottom wall portion, said drain opening being located adjacent said one of said corner portions and with said crease being aligned with and spaced from said drain opening.

2. The tank of claim 1 wherein said crease is aligned between the drain opening and the corner opposite said one of said corner portions.

3. The tank of claim 1 wherein said drain opening is provided with a tapered surface.

4. The tank of claim 1 wherein the notches are square shaped, with the notch at the corner formed by the intersection of said two adjacent sides being larger than the notches at the remaining corners.

5. The tank of claim 1 wherein said crease extends upwardly from said bottom wall portion.

6. The tank of claim 5 wherein said crease is spaced from said drain opening by an interval of approximately four inches.

7. The tank of claim 5 wherein said crease slopes outwardly in a direction transverse to its longitudinal axis.

8. The tank of claim 7 wherein said slope of the crease is about 7 to 10 degrees relative to the horizontal plane of the bottom wall portion.

* * * * *